US009922810B2

(12) United States Patent
Badiei et al.

(10) Patent No.: US 9,922,810 B2
(45) Date of Patent: Mar. 20, 2018

(54) SYSTEMS AND METHODS FOR DETECTION AND QUANTIFICATION OF SELENIUM AND SILICON IN SAMPLES

(71) Applicant: PerkinElmer Health Sciences, Inc., Waltham, MA (US)

(72) Inventors: Hamid Badiei, Woodbridge (CA); Kenneth Neubauer, Monroe, CT (US)

(73) Assignee: PerkinElmer Health Sciences, Inc., Waltham, MA (US)

( * ) Notice: Subject to any disclaimer, the term of this patent is extended or adjusted under 35 U.S.C. 154(b) by 316 days.

(21) Appl. No.: 14/293,457

(22) Filed: Jun. 2, 2014

(65) Prior Publication Data

US 2015/0318159 A1 Nov. 5, 2015

Related U.S. Application Data

(60) Provisional application No. 61/987,429, filed on May 1, 2014.

(51) Int. Cl.
*H01J 49/10* (2006.01)
*H01J 49/00* (2006.01)

(52) U.S. Cl.
CPC ..... *H01J 49/105* (2013.01); *H01J 49/005* (2013.01); *H01J 49/0027* (2013.01); *H01J 49/0077* (2013.01)

(58) Field of Classification Search
CPC ..... H01J 49/105
See application file for complete search history.

(56) References Cited

U.S. PATENT DOCUMENTS 5,426,804 A 6/1995 Wu
6,140,638 A * 10/2000 Tanner et al. ..... 250/282
(Continued)

FOREIGN PATENT DOCUMENTS

WO WO-98/56030 A1 12/1998
WO WO-00/77821 A1 12/2000
WO WO-03/009332 A1 1/2003

OTHER PUBLICATIONS

Hui-tao et al., "Dynamic reaction cell inductively coupled plasma mass spectrometry for determination of silicon in steel", Spectrochimica Acta Part B: atomic Spectroscopy, vol. 58, Issue 1, Jan. 2003.*

(Continued)

*Primary Examiner* — Michael Logie
(74) *Attorney, Agent, or Firm* — Choate, Hall & Stewart, LLP; William R. Haulbrook; Ronen Adato

(57) ABSTRACT

The present disclosure provides methods and systems for improved detection and/or quantification of selenium (Se) and/or silicon (Si) in samples. In certain embodiment, the methods and systems feature the use of carbon dioxide ($CO_2$) as a reaction gas in a reaction cell chamber, such as a dynamic reaction cell (DRC), of an inductively coupled plasma mass spectrometer (ICP-MS). It is found that the use of $CO_2$ as a reaction gas effectively eliminates (or substantially reduces) interfering ionic species for the analytes Se and Si, particularly in samples with complex matrices, and/or in samples with low levels of analyte, thereby enabling more accurate detection of analyte at lower detection limits and in samples having complex matrices.

12 Claims, 5 Drawing Sheets

(56) References Cited

U.S. PATENT DOCUMENTS

| | | | | |
|---|---|---|---|---|
| 6,259,091 | B1 * | 7/2001 | Eiden et al. | 250/281 |
| 6,627,912 | B2 | 9/2003 | Bandura et al. | |
| 6,875,618 | B2 * | 4/2005 | Bandura | G01N 30/72 436/103 |
| 8,426,804 | B2 | 4/2013 | Badiei et al. | |
| 2002/0166959 | A1 * | 11/2002 | Bandura | H01J 49/0045 250/282 |
| 2003/0044994 | A1 * | 3/2003 | Bandura et al. | 436/57 |
| 2006/0113464 | A1 * | 6/2006 | Litherland | B01D 59/44 250/288 |
| 2009/0266984 | A1 * | 10/2009 | Hirano | H01J 37/14 250/288 |
| 2009/0315017 | A1 * | 12/2009 | Song | 257/24 |
| 2012/0091331 | A1 * | 4/2012 | Badiei | H01J 49/005 250/282 |
| 2013/0284917 | A1 * | 10/2013 | Badiei | H01J 49/24 250/288 |
| 2014/0331861 | A1 * | 11/2014 | Makarov | H01J 49/067 95/90 |
| 2015/0129762 | A1 * | 5/2015 | Campbell | H01J 49/0031 250/283 |
| 2015/0187555 | A1 * | 7/2015 | Hirano | H01J 49/061 250/288 |

OTHER PUBLICATIONS

Amr, "The Collision/reaction cell and its application in inductively coupled plasma mass spectrometry for the determination of radioisotopes: a literature review.", Pelagia Research Library, Advances in Applied Science research, 2012.*

Golik et al. (Golik et al., "Using High Resolution and Dynamic Reaction Cell for the Improvement of the Sensitivity of Direct Silicon Determination in Uranium Materials by Inductively Coupled Plasma Mass Spectrometry", Journal of Analytical Chemistry, 2013).*

Bouchoux, G. et al., Theoretical Investigation of Selenium Interferences in Inductively Coupled Plasma Mass Spectrometry, J. Phys. Chem., 116:9058-9070 (2012).

Elwaer, N. and Hintelmann, H., Comparative performance study of different sample introduction techniques for rapid and precise selenium isotope ratio determination using multi-collector inductively coupled plasma mass spectrometry (MC-ICP/MS), Anal. Bioanal. Chem. 389:1889-1899 (2007).

Invitation to Pay Additional Fees with Partial International Search, PCT/US2014/040541, 8 pages, dated Feb. 15, 2015.

Baranov, V. and Tanner S., A Dynamic Reaction Cell for Inductively Coupled Plasma Mass Spectrometry (ICP-DRC-MS). Part 1. The RF-Field Energy Contribution in Thermodynamics of Ion-Molecule Reactions, Journal of Analytical Atomic Spectrometry, 14:8:1133-1142, (1999).

Dickenson, P. et al., The Benefits of NexION 300D ICP-MS Reaction mode in Removing the $Gd^{+2}$ Interference on Selenium in Serum, PerkinElmer, 3 pages, (2013).

Expanding the Capabilities of ICP-MS, PerkinElmer, 12 pages, (2009).

Maximize Lab Efficiency with Unparalleled Speed & Stability, NexION 350 ICP-MS, PerkinElmer, 12 pages, (2014).

Neubauer et al., Low-level Selenium Determination, PerkinElmer Instruments, 4 pages, (2001).

Ong, Kenneth, Determination of Impurities in Silica Wafers with the NexION 300S ICP-MS, PerkinElmer, 5 pages, (2012).

PerkinElmer, The Industry's Most Advanced Yet Intuitive Software, The NexION 300 ICP-MS, 3 pages, (2013).

Pruszkowski, E. and Bosnak, C., The Analysis of Drinking Waters by U.S. EPA Method 200.8 Using the NexION 300D ICP-MS in Standard, Collision and Reaction Modes, 9 pages, (2012).

Tanner et al., A Dynamic Reaction Cell for Inductively Coupled Plasma Mass Spectrometry (ICP-DRC-MS), Part III. Optimization and Analytical Performance, Journal of Analytical Atomic Spectrometry 15:9:1261-1269, (2000).

Tanner et al., Reaction Cells and Collision Cells for ICP-MS: A Tutorial Review, Spectrochimica Acta Part B: Atomic Spectroscopy 57:9:1361-1452, (2002).

Tanner, Scott D., and Vladimir I. Baranov, A Dynamic Reaction Cell for Inductively Coupled Plasma Mass Spectrometry (ICP-DRC-MS). II. Reduction of Interferences Produced Within the Cell, Journal of the American Society for Mass Spectrometry 10:11:1083-1094, (1999).

Tanner, Scott D., and Vladimir I. Baranov, Theory, Design, And Operation of a Dynamic Reaction Cell for ICP-MS, Atomic Spectroscopy, Norwalk Connecticut—20:45-52, (1999).

* cited by examiner

SYSTEMS AND METHODS FOR DETECTION AND QUANTIFICATION OF SELENIUM AND SILICON IN SAMPLES

PRIORITY

This application claims priority to and the benefit of U.S. Provisional Patent Application No. 61/987,429, filed May 1, 2014, titled "Systems and Methods for Detection and Quantification of Selenium and Silicon in Samples," the content of which is incorporated by reference herein in its entirety.

TECHNICAL FIELD

This invention relates generally to composition analysis of samples. In particular embodiments, the invention relates to systems and methods for detecting and quantifying selenium (Se) and/or silicon (Si) in samples.

BACKGROUND

Mass spectrometry (MS) is an analytical technique for determining the elemental composition of unknown sample substances that has both quantitative and qualitative applications. For example, MS is useful for identifying unknown substances, determining the isotopic composition of elements in a molecule, and determining the structure of a particular substance by observing its fragmentation, as well as for quantifying the amount of a particular substance in the sample. Mass spectrometers typically operate by ionizing a test sample using one of many different available methods to form a stream of positively charged particles, i.e. an ion stream. The ion stream is then subjected to mass differentiation (in time or space) to separate different particle populations in the ion stream according to mass-to-charge (m/z) ratio. A downstream mass analyzer can detect the intensities of the mass-differentiated particle populations in order to compute analytical data of interest, e.g., the relative concentrations of the different particle's populations, mass-to-charge ratios of product or fragment ions, and other potentially useful analytical data.

In mass spectrometry, ions of interest ("analyte ions") can coexist in the ion stream with other unwanted ion populations ("interferer ions") that have substantially the same nominal m/z ratio as the analyte ions. In some cases, the m/z ratio of the interferer ions, though not identical, is close enough to the m/z ratio of the analyte ions that it falls within the resolution of the mass analyzer, thereby making the mass analyzer unable to distinguish the two types of ions. Improving the resolution of the mass analyzer is one approach to dealing with this type of interference (commonly referred to as "isobaric" or "spectral interference"). Higher resolution mass analyzers, however, tend to have slower extraction rates and lose significant ion signal as the mass resolution increases. Furthermore, limits on the achievable resolution may also be encountered.

Inductively coupled plasma mass spectrometry (ICP-MS) has been gaining favor with laboratories around the world as the instrument of choice for performing trace elemental analysis. ICP-MS instrument detection limits are at or below the single part-per-billion (ppb) level for much of the periodic table, the analytical working range is nine orders of magnitude, productivity is superior to other techniques, and isotopic analysis can be readily achieved. Most analyses performed on ICP-MS instrumentation are quantitative; however, ICP-MS can perform semi-quantitative and qualitative analysis as well, identifying and/or quantifying an unknown analyte by detecting and/or quantifying any of 80 detectable, differentiable elements, for example.

In ICP-MS analysis, samples are typically introduced into an argon plasma as aerosol droplets. The plasma dries the aerosol, dissociates the molecules, then removes an electron from the components, thereby forming singly-charged ions, which are directed into a mass filtering device known as a mass spectrometer. Most commercial ICP-MS systems employ a quadrupole mass spectrometer which rapidly scans the mass range. At any given time, only one mass-to-charge (m/z) ratio will be allowed to pass through the mass spectrometer from the entrance to the exit. Upon exiting the mass spectrometer, ions strike the first dynode of an electron multiplier, which serves as a detector. The impact of the ions releases a cascade of electrons, which are amplified until they become a measurable pulse. The intensities of the measured pulses are compared to standards, which make up a calibration curve for a particular element, to determine the concentration of that element in the sample.

Most ICP-MS instruments include the following components: a sample introduction system composed of a nebulizer and a spray chamber; an ICP torch and an RF coil for generating the argon plasma that serves as the ion source; an interface that links the atmospheric pressure ICP ion source to a high vacuum mass spectrometer; a vacuum system that provides high vacuum for ion optics, quadrupole, and detector; a collision/reaction cell that precedes the mass spectrometer and is used to remove interferences that can degrade achievable detection limits; ion optics that guide the desired ions into the quadrupole while assuring that neutral species and photons are discarded from the ion beam; a mass spectrometer that acts as a mass filter to sort ions by their mass-to-charge ratio (m/z); a detector that counts individual ions exiting the quadrupole; and a data handling and system controller that controls aspects of instrument control and data handling for use in obtaining final concentration results.

In an inductively coupled plasma ion source, the end of a torch comprising three concentric tubes, typically quartz, is placed into an induction coil supplied with a radio-frequency electric current. A flow of argon gas can then be introduced between the two outermost tubes of the torch, where the argon atoms can interact with the radio-frequency magnetic field of the induction coil to free electrons from the argon atoms. This action produces a high-temperature (perhaps 10,000K) plasma comprised mostly of argon atoms with a small fraction of argon ions and free electrons. The analyte sample is then passed through the argon plasma, for example, as a nebulized mist of liquid. Droplets of the nebulized sample evaporate, with any solids dissolved in the liquid being broken down into atoms and, due to the extremely high temperatures in the plasma, stripped of their most loosely-bound electron to form a singly charged ion.

Thus, the ion stream generated by an ICP ion source often contains, in addition to the analyte ions of interest, a large concentration of argon and argon-based spectral interference ions. For example, some of the more common spectral interference ions include $Ar^+$, $ArO^+$, $Ar_2^+$, $ArCl^+$, $ArH^+$, and $MAr^+$ (where M denotes the matrix metal in which the sample was suspended for ionization), and also may include other spectral interference ions such as $N_2^+$, $CO^+$, $ClO^+$, $MO^+$, and the like. Other types of ion sources, including glow discharge and electrospray ion sources, may also produce non-negligible concentrations of spectral interference ions.

Aside from using high-resolution mass analyzers to distinguish between analyte and interferer ions, another way of mitigating the effects of spectral interferences in the ion stream is to selectively eliminate the interferer ions upstream of the mass analysis stage. According to one approach, the ion stream can be passed through a pressurized cell, referred to as a reaction cell or a dynamic reaction cell (DRC) if a quadrupole is used as the cell, which is filled with a selected gas that is reactive with the unwanted interferer ions, while remaining substantially inert toward the analyte ions. As the ion stream collides with the reactive gas in the reaction cell, the interferer ions form product ions that no longer have substantially the same or similar mass-to-charge (m/z) ratio as the analyte ions. In an alternative approach, the gas is reactive with the analyte ions, while remaining substantially inert toward the unwanted interferer ions. For example, the analyte ions may selectively form product ions with the reactive gas that no longer have substantially the same mass-to-charge (m/z) ratio as the unwanted interferer ions. This is referred to as the "mass shift" approach, where the analyte ion is detected as its corresponding product ion at a higher, interference-free m/z ratio.

If the mass-to-charge (m/z) ratio of the product ion substantially differs from that of the analyte, then conventional mass filtering can be applied to the cell to eliminate the product interferer ions without significant disruption of the flow of analyte ions. Thus, the ion stream can be subjected to a band pass mass filter to transmit only the analyte ions to the mass analysis stage in significant proportions. Use of a reaction cell, such as a DRC, to eliminate interferer ions is described, for example, in U.S. Pat. Nos. 6,140,638; 6,627,912; and 6,875,618, the entire contents of which are incorporated herein by reference.

In general, the reaction cell can provide extremely low detection limits, even on the order of parts or subparts per trillion depending on the analyte of interest. For the same isotope, certain limitations or constraints are imposed upon the reaction cell. For one thing, because the reactive gas must be reactive only with the interferer ion and not with the analyte (or only with the analyte and not with the interferer ion), the reaction cell is sensitive to the analyte ion of interest. Different reactive gases may need to be employed for different analytes. In other cases, there may be no known suitable reactive gas for a particular analyte. In general, it may not be possible to use a single reactive gas to address all spectral interferences.

Selenium (Se) is an essential element to human health at low levels, typically between 20 and 80 micro-gram per liter (μg/L), but becomes toxic at elevated levels. Furthermore, selenium exists in different forms that affect its toxicity and bioavailability. There is a benefit in determining the concentration of selenium in various forms, particularly at very low levels of concentration.

ICP-MS has been used to detect and quantify selenium species and selenium-containing compounds in samples. However, with conventional quadrupole ICP-MS, the most abundant isotope of selenium, $^{80}Se$, cannot be used for the determination due to the interfering $^{40}Ar_2^+$ dimer from the argon plasma which occurs at the same mass-to-charge ratio (m/z). As a result, selenium is normally determined using the $^{82}Se$ isotope, which is only 8.7% abundant. This limits the detection capability for selenium to the 0.5-10 μg/L range using conventional ICP-MS.

Improved selenium detection has been achieved with a reaction cell chamber to eliminate the $Ar_2^+$ background using methane ($CH_4$), for example, as the reaction gas. However, the use of methane as a reaction gas in a reaction cell is ineffective for analysis of certain complex samples due to the resulting complex gas phase chemistry and side reactions, which create new interference ions for selenium.

Another element for which high detection accuracy is often required is silicon (Si), which is a contaminant of petroleum products such as diesel fuel, naphtha, toluene, gasoline, and the like. For example, in the petrochemical industry, there is a strong desire to measure silicon in naphtha, which is a class of organic compound that can be analyzed at ten times (10×) dilution in xylene or another solvent. Analysis of such samples having complex organic matrices is challenging because of the nature of the matrix—high viscosity samples which must be diluted in volatile solvents.

ICP-MS has been used to detect and quantify silicon species in samples with complex organic matrices. However, detection of the major isotope of silicon (m/z 28, 92.2% abundance) suffers from polyatomic interferences, namely, $N_2^+$ and $CO^+$. In organic solvents such as xylene, for example, conventional ICP-MS detects a $CO^+$ signal much higher than normal due to the excess carbon present in the matrix.

Improved silicon ($^{28}Si$) detection in aqueous solutions has been achieved with a reaction cell chamber, such as a DRC, to eliminate interfering ionic species by using ammonia ($NH_3$) as the reaction gas. However, while ammonia may be effective for detection of silicon in aqueous solutions, ammonia is not as effective for detection of silicon in organic matrices, where interfering species such as $CO^+$ are dominant.

As an alternative to the reaction cell approach, collision cell operation may be employed where the ion stream is collided inside the pressurized cell with a substantially inert gas. This is sometimes referred to as kinetic energy discrimination (KED). Here, both the analyte and interferer ions are collided with the inert gas, causing an average loss of kinetic energy in the ions. The amount of kinetic energy lost due to the collisions is related to the collisional cross-section of the ions, which is related to the elemental composition of the ion. Polyatomic ions (also known as molecular ions) composed of two or more bonded atoms tend to have a larger collisional cross-section than do monatomic ions, which are composed only of a single charged atom. This is due to the atomic spacing between the two or more bonded atoms in the polyatomic ion. Consequently, the inert gas can collide preferentially with the polyatomic atoms to cause, on average, a greater loss of kinetic energy than will be seen in monatomic atoms of the same m/z ratio. A suitable energy barrier established at the downstream end of the collision cell can then trap a significant portion of the polyatomic interferer and prevent transmission to the downstream mass analyzer.

Relative to reaction cell operation, collision cell operation has the benefit of being generally more versatile and simpler to operate, because the choice of inert gas does not substantially depend on the particular interferer and/or analyte ions of interest. A single inert gas, which is often helium, can effectively remove many different polyatomic interferences of different m/z ratios, so long as the relative collisional cross-sections of the interferer and analyte ions are as described above. At the same time, certain drawbacks are associated with collision cell operation. In particular, collision cell operation can have lower ion sensitivity than reaction cell operation because some of the reduced energy analyte ions will be trapped, along with the interferer ions, and prevented from reaching the mass analysis quadrupole. The same low levels of ions (e.g. parts and subparts per trillion) can therefore not be detected using collision cell operation. It has been observed that the detection limits can be 10 to 1000 times worse using collision cell operation relative to reaction cell operation. This is the case for detection of selenium and silicon via collision cell operation—sensitivities are poor.

Thus, there is a need for improved methods and systems for the detection of selenium in samples, particularly at low levels. There is also a need for improved methods and systems for the detection of silicon in samples, particularly in samples with complex organic matrices, such as petroleum products.

SUMMARY OF THE INVENTION

Described herein are methods and systems for improved detection and quantification of selenium (Se) and/or silicon (Si) in samples. The use of carbon dioxide ($CO_2$) as a reaction gas in a reaction cell of an inductively coupled plasma mass spectrometer (ICP-MS) is found to effectively eliminate (or substantially reduce) interfering ionic species for the analytes Se and Si, particularly in samples with complex matrices, and/or in samples with low levels of analyte. This result is surprising in that carbon dioxide ($CO_2$) has not heretofore been used in this capacity, as it was previously assumed to be ineffective due to presumed complex gas phase chemistry and side reactions that would limit its ability to reduce or eliminate interfering ionic species.

In one aspect, the invention is directed to a method for producing a stream of ions for detection and/or quantification of selenium (Se) in a sample, the method comprising (including, but not limited to, the following steps): introducing the sample to an ionization source (for example, an ionized carrier gas, such as a plasma), thereby producing an ionized sample stream comprising a plurality of ionic species, said plurality of ionic species comprising: (i) one or more analyte ionic species, said one or more analyte ionic species being an ionized form of one or more species of interest present in the sample, said one or more species of interest comprising selenium (for example, any one or more selenium isotopes, for example, any one or more of the isotopes $^{80}Se$, $^{78}Se$, $^{77}Se$, $^{76}Se$, and $^{74}Se$), and said one or more analyte ionic species comprising $Se^+$; and (ii) one or more interferer ionic species, said one or more interferer ionic species having nominal m/z substantially equivalent to (for example, within 2%, or 1% of) that of $Se^+$; admitting the ionized sample stream into a chamber (for example, a dynamic reaction cell, other type of reaction cell, or other suitable enclosure or channel of any kind) to thereby contact the ionized sample stream with a reaction gas stream comprising $CO_2$ (for example, in a dynamic reaction cell, or other type of reaction cell), thereby reacting the $CO_2$ with at least one of the one or more interferer ionic species and producing one or more products that are not interferer ionic species (for example, wherein the one or more products comprises one or more neutral species); and, following contact of the ionized sample stream with the reaction gas stream comprising $CO_2$, directing the resulting product stream to a mass analyzer and detector (for example, a mass spectrometer) for detection and/or quantification of selenium in the sample.

In certain embodiments, the ionization source (for example, the carrier gas) comprises argon and the one or more interferer ionic species comprises $Ar_2^+$ (for example, any one or more isotopes of $Ar_2^+$).

In certain embodiments, the introducing step comprises introducing the sample as a nebulized mist of liquid into the ionization source.

In certain embodiments, the sample is a drinking water sample. In certain embodiments, the sample is an environmental sample, such as a soil digest or seawater. In certain embodiments, the sample is seawater and the one or more species of interest comprises $^{78}Se$.

In certain embodiments, the sample is a biological sample (for example, the sample comprises urine, saliva, tissue, serum, blood, and/or plasma).

In certain embodiments, the sample comprises a product consumable by a human (for example, food, vitamin, nutritional supplement, and/or drink).

In certain embodiments, the contacting step is conducted with a reaction gas stream having a minimum $CO_2$ flow rate of 0.1 mL/min (or, alternatively, 0.2, 0.3, 0.4, 0.5, 0.6, 0.7, 0.8, 0.9, 1.0, or 1.1 mL/min) and an ionization source gas (for example, ionized carrier gas, for example, plasma gas) flow of no greater than 30 L/min (or, alternatively, no greater than 25 L/min, or 20 L/min). In certain embodiments, the contacting step is conducted with an ionized sample stream resulting from a liquid sample uptake rate of at least 20 μL/min (or, alternatively, at least 75, 100, 125, 150, 175, 200, or 225 μL/min). In certain embodiments, the contacting step is conducted with an ionized sample stream resulting from a liquid sample uptake rate no greater than 5 mL/min (for example, no greater than 3, 2, or 1.5 mL/min, for example, between 250-300 μL/min, or between 1.0-1.5 mL/min, for example, the latter range for Se speciation by LC-ICP-MS).

In another aspect, the invention is directed to a method for producing a stream of ions for detection and/or quantification of silicon (Si) in a sample, the method comprising: introducing a sample to an ionization source (for example, an ionized carrier gas, for example, a plasma), thereby producing an ionized sample stream comprising a plurality of ionic species, said plurality of ionic species comprising: (i) one or more analyte ionic species, said one or more analyte ionic species being an ionized form of one or more species of interest present in the sample, said one or more species of interest comprising silicon (for example, any one or more silicon isotopes, for example, any one or more of $^{28}Si$, $^{29}Si$, and $^{30}Si$), and said one or more analyte ionic species comprising $Si^+$; and (ii) one or more interferer ionic species, said one or more interferer ionic species having nominal m/z substantially equivalent to (for example, within 2%, or 1% of) that of $Si^+$; admitting the ionized sample stream into a chamber (for example, a dynamic reaction cell, other type of reaction cell, or other enclosure or channel of any kind) to thereby contact the ionized sample stream with a reaction gas stream comprising $CO_2$ (for example, in a dynamic reaction cell, or other type of reaction cell), thereby reacting the $CO_2$ with at least one of the one or more interferer ionic species and producing one or more products that are not interferer ionic species (for example, wherein the one or more products comprises one or more neutral species); and, following contact of the ionized sample stream with the reaction gas stream comprising $CO_2$, directing the resulting product stream to a mass analyzer and detector (for example, a mass spectrometer) for detection and/or quantification of silicon in the sample.

In certain embodiments, the one or more interferer ionic species comprises one or both of $CO^+$ and $N_2^+$.

In certain embodiments, the introducing step comprises introducing the sample as a nebulized mist of liquid into the ionization source.

In certain embodiments, the sample is a dilution in a solvent (for example, wherein the solvent is an organic solvent, such as xylene, or an inorganic solvent).

In certain embodiments, the sample is a petrochemical sample, for example, diesel fuel, naphtha, toluene, or gasoline. In certain embodiments, the petrochemical sample comprises an organic matrix (for example, naphtha).

In certain embodiments, the sample comprises at least one member selected from the group consisting of a metal (for example, steel), a semiconductor, and a mineral. In certain embodiments, the sample comprises a photoresist.

In certain embodiments, the contacting step is conducted with a reaction gas stream having a minimum $CO_2$ flow rate of 0.1 mL/min (or, alternatively, 0.2, 0.3, or 0.4 mL/min) and an ionization source gas (for example, ionized carrier gas, e.g., plasma gas) flow of no greater than 40 L/min (or, alternatively, no greater than 35 L/min, or 30 L/min). In certain embodiments, the contacting step is conducted with an ionized sample stream resulting from a liquid sample uptake rate of at least 50 μL/min (or, alternatively, at least 75, 100, 125, 150, or 175 μL/min). In certain embodiments, the liquid sample uptake rate is no greater than 5.0 mL/min (for example, no greater than 3, 2, or 1.5 mL/min, for example, between 250-300 μL/min, or between 1.0-1.5 mL/min, for example, the latter range for Se speciation by LC-ICP-MS).

Elements of embodiments described with respect to a given aspect of the invention may be used in various embodiments of another aspect of the invention. For example, it is contemplated that features of dependent claims depending from one independent claim can be used in apparatus and/or methods of any of the other independent claims.

BRIEF DESCRIPTION OF THE DRAWINGS

The foregoing and other objects, aspects, features, and advantages of the present disclosure will become more apparent and better understood by referring to the following description taken in conjunction with the accompanying drawings, in which.

Figure 1:
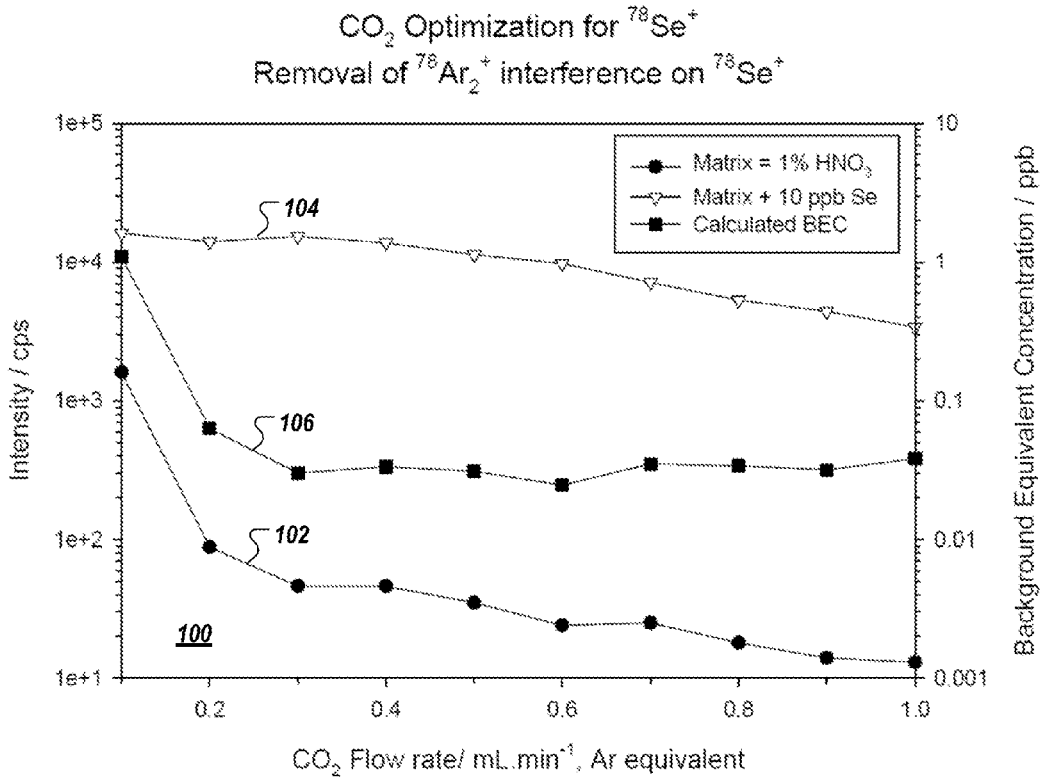
FIG. 1 is a plot demonstrating removal of interfering ion $^{78}Ar_2^+$ {e.g., $^{40}Ar^{38}Ar$} for the analyte $^{78}Se^+$ using carbon dioxide ($CO_2$) as a reaction gas in a dynamic reaction cell (DRC) of an inductively coupled plasma mass spectrometer (ICP-MS), according to an illustrative embodiment of the invention.

The features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements.

DETAILED DESCRIPTION

It is contemplated that systems, devices, methods, and processes of the claimed invention encompass variations and adaptations developed using information from the embodiments described herein. Adaptation and/or modification of the systems, devices, methods, and processes described herein may be performed by those of ordinary skill in the relevant art.

Throughout the description, where articles, devices, and systems are described as having, including, or comprising specific components, or where processes and methods are described as having, including, or comprising specific steps, it is contemplated that, additionally, there are articles, devices, and systems of the present invention that consist essentially of, or consist of, the recited components, and that there are processes and methods according to the present invention that consist essentially of, or consist of, the recited processing steps.

It should be understood that the order of steps or order for performing certain action is immaterial so long as the invention remains operable. Moreover, two or more steps or actions may be conducted simultaneously.

The mention herein of any publication, for example, in the Background section, is not an admission that the publication serves as prior art with respect to any of the claims presented herein. The Background section is presented for purposes of clarity and is not meant as a description of prior art with respect to any claim.

Methods and systems are described herein that feature the use of carbon dioxide ($CO_2$) as a reaction gas in a reaction cell chamber, such as a dynamic reaction cell (DRC), of an inductively coupled plasma mass spectrometer (ICP-MS). It is found that the use of $CO_2$ as a reaction gas effectively eliminates (or substantially reduces) interfering ionic species for the analytes selenium (Se) and silicon (Si), particularly in samples with complex matrices, and/or in samples with low levels of analyte, thereby enabling more accurate detection of these analytes at lower detection limits and/or in samples having complex matrices.

While the creation of ionization sources described herein is demonstrated with an inductively coupled plasma (ICP) mass spectrometer system, other ionization sources could be used as well. For example, in some embodiments, electron ionization, chemical ionization, ion-attachment ionization, gas discharge ion sources, desorption ionization sources, spray ionization (e.g., electrospray ionization), and/or ambient ionization sources can be used. In some embodiments, in addition to ICP, other gas discharge ion sources include, but are not limited to, microwave induced plasma, glow discharge, spark ionization, and closed drift ion sources.

Thus, methods and systems are described herein for producing a stream of ions for detection and/or quantification of selenium (Se) and/or silicon (Si) in a sample. The resultant beam may be analyzed, for example, via mass spectrometer (MS), for example, linear quadrupole MS, quadrupole ion trap MS, ion cyclotron resonance MS, time-of-flight MS, magnetic and/or electric sector MS, and quadrupole ion trap time-of-flight MS. Combined use of a mass spectrometer (MS) with other tools for speciation analysis is also contemplated, for example, use of a mass spectrometer (MS) with gas chromatography (GC), high-performance liquid chromatography (HPLC) and/or field flow fractionation (FFF).

Selenium Detection and Quantification

Where argon is used as carrier gas to maintain the plasma in ICP-MS, the major isotopes of selenium, $^{78}Se$ (23.8% abundant) and $^{80}Se$ (49.6% abundant), have argon-based polyatomic interferences, $Ar_2^+$. Furthermore, for environmental samples with complex matrices, a currently used reaction gas, methane ($CH_4$), can result in new interferences forming.

By contrast, it is found that carbon dioxide ($CO_2$), when used as a reaction gas, reacts rapidly with the primary interferences without creating new interferences. Carbon dioxide ($CO_2$) is non-reactive with (or negligibly reactive with) $Se^+$ (rate constant k is less than $5\times10^{-13}$ $cm^3$ molecule$^{-1}$ $s^{-1}$), and reacts rapidly with the main interferences in Se detection, as shown in reaction Equation 1:

$$Ar_2^+ + CO_2 \rightarrow CO_2^+ + 2Ar \quad k \approx 10^{-9}\ cm^3\ molecule^{-1}\ s^{-1} \tag{1}$$

$CO_2$ Flow Rate Optimization: Removal of $Ar_2^+$ for Detection of Se

FIG. 1 is a plot 100 demonstrating removal of interfering ion $^{78}Ar_2^+$ {e.g., $^{40}Ar^{38}Ar^+$} for the analyte $^{78}Se^+$ using carbon dioxide ($CO_2$) as a reaction gas in a dynamic reaction cell (DRC) of an inductively coupled plasma mass spectrometer (ICP-MS), specifically, the NexION 300D ICP-MS, manufactured by PerkinElmer, Inc. of Waltham, Mass. The instrument conditions for this experiment and other experiments described herein (unless otherwise indicated) were RF Power at 1600 W, use of a glass concentric nebulizer, use of a glass cyclonic spray chamber, and use of nickel cones.

A matrix—in this example, a 1 weight percent (wt. %) nitric acid ($HNO_3$) solution in water—was aspirated, and an intensity reading was obtained for the $^{78}Se^+$ analyte at each of a plurality of flow rates of carbon dioxide ($CO_2$) into the DRC, shown in the plot of FIG. 1. The resulting curve 102 is labeled "Matrix=1% $HNO_3$" in FIG. 1 (logarithmic plot). As the carbon dioxide ($CO_2$) flow rate increases, the measured intensity generally decreases.

Next, a solution containing the matrix (1 wt. % $HNO_3$ solution), with 10 parts-per-billion (ppb) selenium (Se) spike, was aspirated, and an intensity reading was obtained for the analyte $^{78}Se^+$ at each of a plurality of flow rates of carbon dioxide ($CO_2$) injected into the DRC. The resulting curve 104 is labeled "Matrix+10 ppb Se" in FIG. 1 (in the same logarithmic plot).

From the "Matrix" curve 102 and "Matrix+10 ppb" curve 104, a background equivalent concentration (BEC) of the analyte was calculated for each flow rate of carbon dioxide ($CO_2$) injected into the DRC, and the resulting BEC curve 106 was plotted. The BEC is a function of the analyte contamination in the matrix and the incomplete reaction and/or removal of the interfering ionic species. The optimum flow of carbon dioxide ($CO_2$) may be achieved and/or determined where the BEC is minimized. In this example, as shown in FIG. 1, the BEC of the analyte $^{78}Se^+$ ranged from 25-40 parts-per-trillion (ppt). The plots in FIG. 1 demonstrate the effective removal of interfering species $78Ar_2^+$ {e.g., $^{40}Ar^{38}Ar^+$} for the analyte $^{78}Se^+$.

Figure 2:
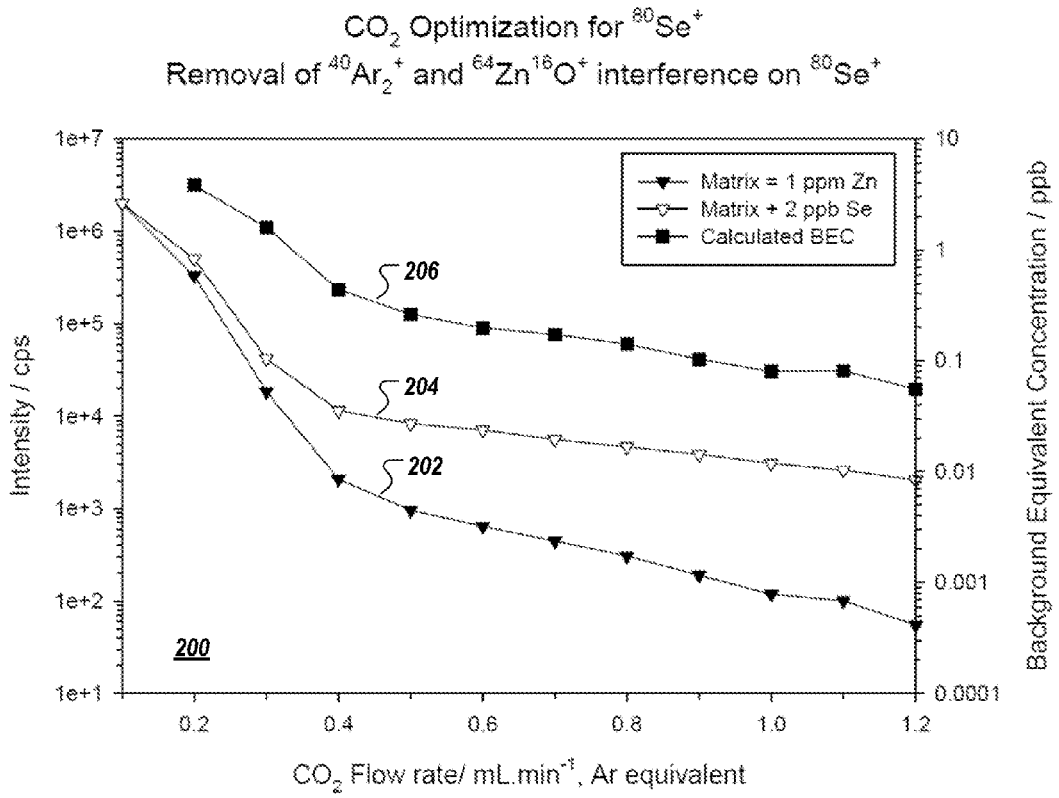
FIG. 2 is a plot demonstrating removal of interfering ions $^{40}Ar_2^+$ {e.g., $^{40}Ar^{40}Ar^+$} and $^{64}Zn^{16}O^+$ for the analyte $^{80}Se^+$ using carbon dioxide ($CO_2$) as a reaction gas in a dynamic reaction cell (DRC) of an inductively coupled plasma mass spectrometer (ICP-MS), according to an illustrative embodiment of the invention.

$CO_2$ Flow Rate Optimization: Removal of $Ar_2^+$ and $Zn^+$ for Detection of Se FIG. 2 is a plot 200 demonstrating the removal of interfering ions $^{40}Ar_2^+$ {e.g., $^{40}Ar^{40}Ar$} and $^{64}Zn^{16}O^+$ for the analyte $^{80}Se^+$ using carbon dioxide ($CO_2$) as a reaction gas in a dynamic reaction cell (DRC) of an inductively coupled plasma mass spectrometer (ICP-MS), again, the NexION 300D ICP-MS. A matrix—in this example, a 1 part-per-million (ppm) zinc (Zn) solution in water ($H_2O$)—was aspirated, and an intensity reading was obtained for the $^{80}Se^+$ analyte at a plurality of flow rates of carbon dioxide ($CO_2$) into the DRC, shown in the plot of FIG. 2. The resulting curve 202 is labeled "Matrix=1 ppm Zn" in FIG. 2 (in a logarithmic plot). As the carbon dioxide ($CO_2$) flow rate increases, the measured intensity is seen to generally decrease.

Next, a solution containing the matrix (1 ppm Zn solution in water), with a 2 ppb selenium (Se) spike, was aspirated, and an intensity reading was obtained for the $^{80}Se^+$ analyte at each of a plurality of flow rates of carbon dioxide ($CO_2$) injected into the DRC. The resulting curve 204 is labeled "Matrix+2 ppb Se" in FIG. 2.

From the "Matrix" curve 202 and "Matrix+2 ppb Se" curve 204, a background equivalent concentration (BEC) of the analyte was calculated for each flow rate of $CO_2$ into the DRC, and the resulting BEC curve 206 was plotted. Background equivalent concentration is a function of analyte contamination in the matrix and incomplete reaction/removal of the interfering ionic species. The optimum flow of carbon dioxide ($CO_2$) may be achieved and/or determined where the BEC is minimized. As shown in FIG. 2, the BEC ranged from 60-120 parts-per-trillion (ppt). The plots in FIG. 2 demonstrate effective removal of interfering species $^{40}Ar_2^+$ and $^{64}Zn^{16}O^+$ for the analyte $^{80}Se^+$.

Spike Recovery Tests Using $CO_2$—Se Detection in a Drinking Water Standard Reference Material (SRM) Matrix In another series of experiments for the detection of selenium (Se) and removal of interfering species using carbon dioxide ($CO_2$) as a reaction gas in a DRC of the ICP-MS, the following conditions were used: auxiliary flow of 1.2 L/min; plasma flow of 15 L/min; injector diameter 2.0 mm; spray chamber temperature at room temperature; no oxygen ($O_2$) flow (into the spray chamber); $CO_2$ flow of 0.6 or 1.2 mL/min (higher flow rate was found useful to reduce $ZnO^+$ at a mass-to-charge (m/z) ratio of 80 in matrices with high zinc (Zn) content); RPq (the q parameter from the Mathieu equation) of 0.80; and a sample uptake of 250 μL/min.

First, to demonstrate detection of selenium (Se) in an environmental sample, with elimination of interfering ion species, a drinking water SRM matrix was used for spike recovery tests. A spike recovery test can be carried out to determine levels of analyte in a sample that can be analyzed without significant matrix suppression. Calibrations were performed (external) in a 1 wt. % nitric acid ($HNO_3$) solution in water, with 2, 5, and 10 μg/L Se. Results of the detection of $^{78}Se$ and $^{80}Se$ in the drinking water SRM using the two different flow rates (0.6 or 1.2 mL/min) of $CO_2$ are shown in Table 1 and Table 2, respectively.

TABLE 1

Detection of $^{78}Se$ and $^{80}Se$ in Drinking Water SRM using $CO_2$ flow rate of 0.60 mL/min

| Sample ID | Certified (μg/L) | $^{78}Se$ (μg/L) | % Recovery | $^{80}Se$ (μg/L) | % Recovery |
|---|---|---|---|---|---|
| Trace Metals in Drinking Water (TMDW) | 10 | 10.1 | 101 | 10.0 | 100 |

TABLE 2

Detection of $^{80}Se$ in Drinking Water SRM using $CO_2$ flow rate of 1.20 mL/min

| Sample ID | Certified (μg/L) | $^{80}Se$ (μg/L) | % Recovery |
|---|---|---|---|
| Trace Metals in Drinking Water (TMDW) | 10 | 10.4 | 104 |

As shown in Table 1 and Table 2 above, good recoveries for both selenium (Se) isotopes, $^{78}Se$ and $^{80}Se$, were achieved at both carbon dioxide ($CO_2$) flow rates, 0.60 mL/min and 1.20 mL/min.

Spike Recovery Tests Using $CO_2$—Se Detection in Soil-Digest SRM Matrices

Additional experiments were conducted to detect selenium (Se), with elimination of interfering ion species, in soil digest SRM matrices (including river sediment, soil solution, and estuarian soil). Calibrations were performed (external) in a 1 wt. % nitric acid ($HNO_3$) solution in water, with 2, 5, and 10 μg/L Se. Results of the detection of $^{78}Se$ and $^{80}Se$ in the soil digest SRM using two different flow rates (0.6 or 1.2 mL/min) of $CO_2$ are shown in Table 3 and Table 4, respectively.

TABLE 3

Detection of $^{78}Se$ and $^{80}Se$ in Soil Sample using $CO_2$ flow rate of 0.60 mL/min

| Sample | Certified (μg/L) | $^{78}Se$ (μg/L) | % Recovery | $^{80}Se$ (μg/L) | % Recovery |
|---|---|---|---|---|---|
| River Sediment-A | 20 | 20.1 | 101 | 20.8 | 104 |
| Soil Solution-A | 10 | 10.5 | 105 | 9.51 | 95 |
| Estuarian Soil | 50 | 48.1 | 96 | 48.4 | 97 |

TABLE 4

Detection of $^{80}Se$ in Soil Sample using $CO_2$ flow rate of 1.20 mL/min

| Sample | Certified (μg/L) | $^{80}Se$ (μg/L) | % Recovery |
|---|---|---|---|
| River Sediment-A | 20 | 20.3 | 102 |
| Soil Solution-A | 10 | 9.07 | 91 |
| Estuarine Soil | 50 | 47.5 | 95 |

As shown in Table 3 and Table 4, good recoveries for both Se isotopes, $^{78}Se$ and $^{80}Se$, were achieved at both $CO_2$ flow rates, for all three soil digest matrices.

Spike Recovery Tests Using $CO_2$—Se Detection in Spiked and Non-Spiked Interferents Check Standard A (ICS-A) Matrices Next, experiments were conducted to detect selenium (Se), with elimination of interfering ion species, in a check standard, Interferents Check Standard A (ICS-A), spiked with either 0, 1, or 5 μg/L Se. Calibrations were performed (external) in a 1 wt. % nitric acid ($HNO_3$) solution in water, with 2, 5, and 10 μg/L Se. Results of the detection of $^{78}Se$ and $^{80}Se$ in the spiked and non-spiked Interferents A Check Solutions using the two different flow rates of $CO_2$ (0.6 and 1.2 mL/min) are shown in Table 5 and Table 6, respectively.

TABLE 5

Detection of $^{78}Se$ and $^{80}Se$ in ICS-A using $CO_2$ flow rate of 0.60 mL/min

| Sample | $^{78}Se$ (μg/L) | % Recovery | $^{80}Se$ (μg/L) | % Recovery |
|---|---|---|---|---|
| Interferents A-10x | 0.68 | — | 0.33 | — |
| Interferents A-10x + 1 μg/L Se | 1.21 | 53 | 1.34 | 101 |
| Interferents A-10x + 5 μg/L Se | 4.84 | 83 | 4.96 | 93 |

TABLE 6

Detection of $^{80}Se$ in ICS-A using $CO_2$ flow-rate of 1.20 mL/min

| Sample | $^{80}Se$ (μg/L) | % Recovery |
|---|---|---|
| Interferents A-10x | 0.06 | — |
| Interferents A-10x + 1 μg/L Se | 1.15 | 109 |
| Interferents A-10x + 5 μg/L Se | 4.83 | 95 |

As shown in Table 5 and Table 6, good recoveries for $^{30}Se$ were seen at both $CO_2$ flow rates.

Thus, the use of carbon dioxide ($CO_2$) as a reaction gas in a dynamic reaction cell (DRC) of an inductively coupled plasma mass spectrometer (ICP-MS) is demonstrated to eliminate interfering ion species, thereby enabling accurate quantification of levels of Se in environmental samples.

Silicon (Si) Detection and Quantification

For detection and quantification of silicon (Si) in samples via ICP-MS, prior use of ammonia ($NH_3$) as a reaction gas in a DRC have proven ineffective for detection of silicon (Si) in organic matrices, where interfering species such as $CO^+$ are dominant. In the petrochemical industry, there is a strong desire to measure Si in naphtha, for example, which are a class of organic compounds typically analyzed at about ten times (10×) dilution in xylene or other suitable solvent. The major isotope of silicon (mass-to-charge (m/z) ratio of 28, at 92.2% abundance) suffers from polyatomic interferences, $N_2$ and $CO^+$. In organic solvents such as xylene, the $CO^+$ signal is much higher than normal due to excess carbon.

It is found that when carbon dioxide ($CO_2$) is used as a reaction gas, it reacts rapidly with the primary interferences ($CO^+$ and $N_2^+$) without creating new interferences. Carbon dioxide ($CO_2$) is non-reactive with $Si^+$, and reacts rapidly with the main interferences in silicon (Si) detection, as shown in reaction Equations 2 and 3 as follows:

$$CO^+ + CO_2 \rightarrow CO_2^+ + CO \quad k \approx 10^{-9}\ \text{cm}^3\ \text{molecule}^{-1}\ \text{s}^{-1} \tag{2}$$

$$N_2^+ + CO_2 \rightarrow CO_2^+ + N_2 \quad k \approx 10^{-10}\ \text{cm}^3\ \text{molecule}^{-1}\ \text{s}^{-1} \tag{3}$$

Experiments described herein demonstrate that the use of carbon dioxide ($CO_2$) as a reaction gas enables measurement of silicon (Si) at levels as low as 10 μg/L in organic solvents.

Figure 3:
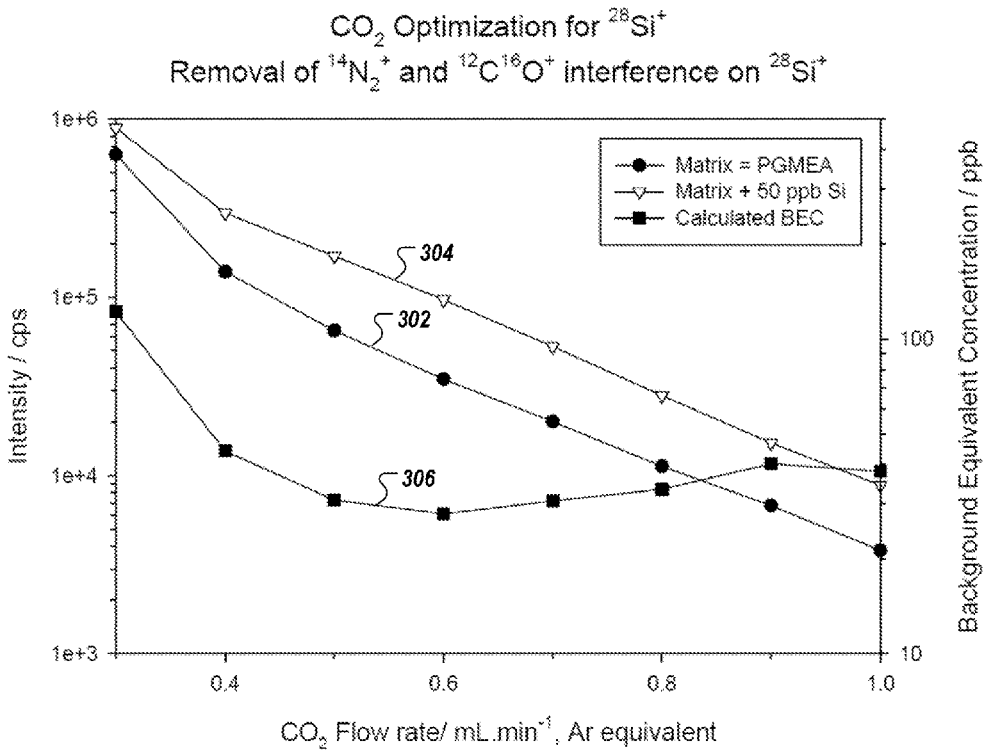
FIG. 3 is a plot demonstrating removal of interfering ions $^{14}N_2^+$ and $^{12}C^{16}O^+$ for the analyte $^{28}Si^+$ using carbon dioxide ($CO_2$) as a reaction gas in a dynamic reaction cell (DRC) of an inductively coupled plasma mass spectrometer (ICP-MS), according to an illustrative embodiment of the invention.

$CO_2$ Flow Rate Optimization: Removal of $N_2^+$ and $CO^+$ for Detection of Si FIG. 3 is a plot 300 demonstrating the removal of interfering ions $^{14}N_2^+$ and $^{12}C^{16}O^+$ for the analyte $^{28}Si^+$ using carbon dioxide ($CO_2$) as a reaction gas in a dynamic reaction cell (DRC) of an inductively coupled plasma mass spectrometer (ICP-MS), specifically, the NexION 300D ICP-MS, manufactured by PerkinElmer, Inc. of Waltham, Mass. The instrument conditions for this experiment and others described herein (unless noted otherwise) were RF Power at 1600 W, use of a glass concentric nebulizer, use of a glass cyclonic spray chamber, and use of nickel cones.

A matrix—in this case, PGMEA (propylene glycol monomethyl ether acetate), an organic solvent used in the semiconductor industry—was aspirated, and an intensity reading was obtained for the $^{28}Si^{+}$ analyte at each of a plurality of flow rates of carbon dioxide ($CO_2$) injected into the DRC, shown in the plot of FIG. 3. The resulting curve 302 is labeled "Matrix=PGMEA" in FIG. 3 (logarithmic plot). As the carbon dioxide ($CO_2$) flow rate increases, the measured intensity is seen to decrease.

Next, a solution containing the matrix (PGMEA), with a 50 parts-per-billion (ppb) silicon (Si) spike, was aspirated, and an intensity reading was obtained for the $^{28}Si^{+}$ analyte at each of a plurality of flow rates of carbon dioxide ($CO_2$) into the DRC. The resulting curve 304 is labeled "Matrix+50 ppb Si" in FIG. 3. From the "Matrix" curve 302 and "Matrix+50 ppb Si" curve 304, a background equivalent concentration (BEC) of the analyte was calculated for each flow rate of carbon dioxide ($CO_2$) into the DRC, and the resulting BEC curve 306 was plotted. BEC is a function of analyte contamination in the matrix and incomplete reaction/removal of the interfering ionic species. The optimum flow of carbon dioxide ($CO_2$) may be achieved and/or determined where the BEC is minimized. Here, the BEC was about 30 parts-per-billion (ppb). The plots in FIG. 3 demonstrate the effective removal of interfering species $^{14}N_2^{+}$ and $^{12}C^{16}O^{+}$ for the analyte $^{28}Si^{+}$. The sample has significant silicon (Si) contamination, resulting in the high BEC; nevertheless, the signal at mass-to-charge (m/z) ratio 28 is reduced significantly with carbon dioxide ($CO_2$) as reaction gas, allowing the silicon (Si) spike to be seen.

Spike Recovery Tests Using $CO_2$—Si Detection in Naphtha Samples

In another series of experiments for the detection of silicon (Si) and removal of interfering species using carbon dioxide ($CO_2$) as a reaction gas in a DRC of the ICP-MS, the following conditions were used: auxiliary flow of 2.0 L/min; plasma flow of 20 L/min; injector diameter of 0.85 mm; spray chamber temperature at −20° C.; $O_2$ flow (into the spray chamber) of 40 mL/min; $CO_2$ flow of 0.5 mL/min; RPq of 0.50; and sample uptake of 190 μL/min (Viton+PTFE tubing).

Naphtha samples were used (Stoddard Solvent, Ligroin, and Petroleum Ether), each diluted ten times (10×) in xylene. Calibrations were performed (external) in xylene, with 10, 20, 30, and 40 μg/L Si. Results of the detection of $^{28}Si$ using 0.5 mL/min flow rate of $CO_2$ are shown in Table 7 below (units in μg/L).

TABLE 7

Detection of $^{28}Si$ in naphtha using $CO_2$ flow-rate of 0.5 mL/min

| | Sample | +20 μg/L Si | % Recovery |
|---|---|---|---|
| Stoddard Solvent | 4.09 | 21.3 | 86 |
| Ligroin | 6.50 | 26.1 | 98 |
| Petroleum Ether | 5.72 | 27.5 | 109 |

Readings below 10 parts-per-billion (ppb) were achieved, and good spike recoveries were seen for all matrices.

Thus, the use of carbon dioxide ($CO_2$) as a reaction gas in a dynamic reaction cell (DRC) of an inductively coupled plasma mass spectrometer (ICP-MS) is demonstrated to eliminate interfering ion species, thereby enabling accurate quantification of levels of Si in organic solvents.

ICP-MS System

Figure 4:
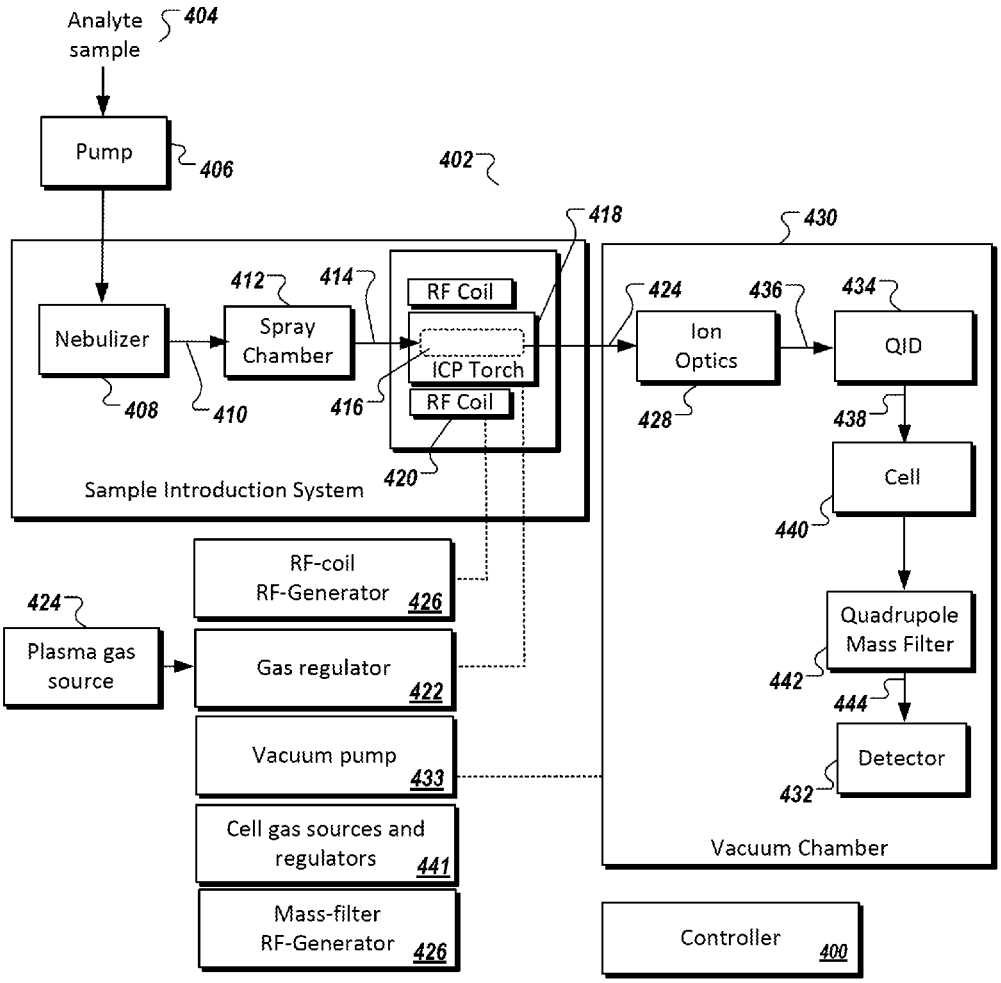
FIG. 4 is a block diagram representing an example multi-mode ICP-MS system for performing a method for producing a stream of ions for detection and/or quantification of silicon (Si) and/or selenium (Se) in a sample, according to an illustrative embodiment of the invention.

FIG. 4 is a block diagram of an example multi-mode inductively coupled plasma mass spectrometry (ICP-MS) system 400 for producing a stream of ions for detection and/or quantification of silicon (Si) and/or selenium (Se) in a sample, according to embodiments described herein.

In FIG. 4, the ICP-MS system 402 includes a sample introduction system to receive an analyte sample 404. The analyte sample 404 is preferably a liquid or dispensed in a liquid, though, in some embodiments, the analyte sample is a solid. In some embodiments, the analyte sample 404 is introduced, for example, by a peristaltic pump 406 or through self-aspiration to a nebulizer 408 to transform the analyte sample into an aerosol of fine droplets 410. Examples of the nebulizer 408 may include, but are not limited to, concentric, cross-flow, Babington, V-Groove, HEN ("high-efficiency"), and MCN ("micro-concentric") nebulizers. The fine droplets 410 generated by the nebulizer 408 may be passed through a spray chamber 412 to allow only fine droplets 414 that are below certain sizes to enter a plasma 416, typically composed of argon, generated by an ICP torch 418 and RF-coil 420. In some embodiments, examples of the spray chamber 412 include, but are not limited to, Scott or Cyclonic chambers. The plasma gas (e.g., argon) may be introduced by a gas regulator 422 that is coupled to a plasma gas source 424. In some implementations, the ICP torch 418 may comprise a series of concentric quartz tubes that are enveloped by the RF-coil 420. In some embodiments, the RF coil 420 is coupled to and energetically supplied by an RF-generator 426.

Upon entering the plasma 414, the fine droplets 414 are dried and heated until the fine droplets 414 turn into a gas. As the atoms of the heated gas 414 continue to travel through the plasma 416, they absorb energy from the plasma 416 and form singly charged ions. The singly charged ions 424 exit the plasma 416 and are directed, as an ion beam 424 to an ion optics assembly 428.

The ion optics assembly 428 provides an interface to the plasma 416. In some implementations, the ion optics assembly 428 includes a series of inverted cones having an orifice to allow the passage of the ion beam 424 while maintaining a high-vacuum environment within a vacuum chamber 430. The vacuum environment reduces the chances of ions of the ion beam 424 from inadvertently colliding with gas molecules between the ion optic assembly 428 and the detector 432. In some implementations, the vacuum chamber 430 is coupled to one or more vacuum pumps 433 such as, for example, a turbo-molecular pump and a mechanical roughing pump that operate together to provide the high-vacuum environment. In some implementations, the vacuum pump 433, and/or another pump, may be employed to evacuate the interface region of the ion optic assembly 428.

In some embodiments, the ICP-MS system 402 includes a quadrupole ion deflector (QID) 434, to allow only ions of a specified mass range to pass into the cell 440 and prevent (or substantially reduce) the passage of non-ionized materials, such as neutrals and photons. The QID 434 is configured to filter the non-ionized materials that may cause measurement drifts or degrade the detection limits of the analyte ions of interest. Non-ionized material may be erroneously counted as ions by the detectors 432. In some implementations, the QID 434 includes a number of rods, which may be a magnetic or an electromagnetic source, configured to turn the direction of the ion beam 436 received from the ion optic assembly 428 to disaggregate (i.e., filter) the ionized portion of the beam 438 (which includes the analyte ions) from the non-ionized portion of the beam (e.g., neutrals, photons, and other non-ionized particles). Alternatively, in certain implementations, an autolens assembly may be employed to provide such mass pre-filtering functions.

In some embodiments, the ICP-MS system 402 includes one or more collision and/or reaction cells. In some implementations, the collision or reaction cell may be integrated as a universal cell 440, and may be operated as either a reaction cell chamber or a collision cell chamber, depending on the selected mode of operation of the ICP-MS. The universal cell 440 may couple to one or more gas sources 441 that provide(s) pressurized gas 443 (for example, carbon dioxide ($CO_2$)) to the chamber to react with interferer ionic species (such as $^{78}Ar_2^+$, $^{40}Ar_2^+$, $^{64}Zn^{16}O^+$, $^{14}N_2^+$, and $^{12}C^{16}O^+$) in the ion stream 438. The universal cell 440 may optionally include an energy barrier, which may be energized, such as during the operation of the ICP-MS system 402 in collision mode, to further distinguish high-energy analyte ions (ions of interest) from interferent lower-energy ions. The universal cell 440 may include a quadrupole rod set within its interior spacing. The quadrupole rod set may be linked to a voltage source to receive an RF voltage suitable for creating a quadrupolar field.

Thus, in certain embodiments, the reaction cell (or, in this case, universal cell) 440 includes a pressurized chamber into which the ionized sample stream 438 is admitted to contact the carbon dioxide ($CO_2$), thereby reacting the carbon dioxide ($CO_2$) with at least one of the one or more interferer ionic species and producing one or more products that are not interferer ionic species. The ion stream 438 includes the analyte ionic species, such as $Se^+$ (e.g., $^{80}Se^+$, $^{78}Se^+$, among others) and/or $Si^+$ (e.g., $^{28}Si^+$, among others). The ion stream 438 also includes interferer ionic species (for example, $^{78}Ar_2^+$, $^{40}Ar_2^+$, $^{64}Zn^{16}O^+$, $^{14}N_2^+$, and $^{12}C^{16}O^+$) for the particular analyte ionic species. In the universal cell 440, the carbon dioxide ($CO_2$) quickly reacts with the interferer ionic species, while remaining non-reactive (or negligibly reactive) with the analyte ionic species. The resulting reaction produces byproduct ions (for example, $CO_2^+$), as shown above in Equations 1-3. The byproduct ions no longer have the same or substantially the same m/z ratio as the analyte ions, and conventional mass filtering can be applied to eliminate the product interferer ions without disruption of the flow of analyte ions. For example, the stream can be subjected to a band pass mass filter to transmit only the analyte ions to the mass analysis stage. Use of a reaction cell to eliminate interferer ions is described further in U.S. Pat. Nos. 6,140,638; 6,627,912; and 8,426,804. In certain embodiments, the quadrupolar field generated by the quadrupole cell rod provides radial confinement of ions being transmitted along its length from the entrance end toward the exit end of the cell 440, allowing passage of the analyte ionic species out of the cell and restricting passage of byproduct ions out of the cell.

Referring back to FIG. 4, in certain embodiments, following contact of the ionized sample stream with the reaction gas stream in the cell 440, the resulting product stream is directed to a mass analyzer and detector for detection and/or quantification of analyte ionic species. As shown in FIG. 4, in some embodiments, the ICP-MS system 402 includes a mass spectrometer such as a quadrupole mass spectrometer 442 to separate singly charged ions from each other by mass. In some embodiments, the quadrupole mass spectrometer 442 restricts the passage of the ions 444 to only one mass-charge (m/z) ratio (e.g., pre-specified m/z ratio) associated with a given ion in the ion beam. In some implementations, time-of-flight or magnetic sector mass spectrometer may be employed. The quadrupole mass spectrometer 442 may couple with an RF generator 446 that provides a RF power at specified voltages and frequencies. The quadrupole mass spectrometer 442 may employ both direct current and alternating current electrical fields to separate the ions.

Subsequent to the quadrupole mass spectrometer 442, the detector 432 receives the mass-filtered ions 444 to produce an electronic signal that corresponds to the number of detected analyte ionic species. The detector 432 may couple to a signal processing and amplification circuitries to process the measured signal. The detector 432 counts the total signal for each mass charge, which may be aggregated to form a mass spectrum. The magnitude of the measured intensity values may be scaled based on a calibration standard such that the outputs are provided on a scale proportional to the concentration of the elements or analyte ions.

In some embodiments, the ICP-MS system 402 includes one or more controllers to operate and monitor the operation of the quadrupole mass filter 442, the ignition of the plasma 416 by the ICP torch 418 and the RF coil 420, the pressure regulation of the vacuum chamber 430, the operation of the universal cell 440, and/or the operation of the quadrupole ion deflector 434, among other functions. The controller 400 may be operatively connected to the various mechanical and electrical components of the ICP-MS system 402.

In some embodiments, the controller 400 includes hardware and/or software capable of executing algorithms, computer programs, and/or computer applications necessary for the operation of the ICP-MS system. For example, the controller 400 may include a processor and a non-transitory computer readable medium having instructions stored thereon, wherein the instructions, when executed by the processor, cause the processor to perform the functions necessary for operation of the ICP-MS system.

Figure 5:
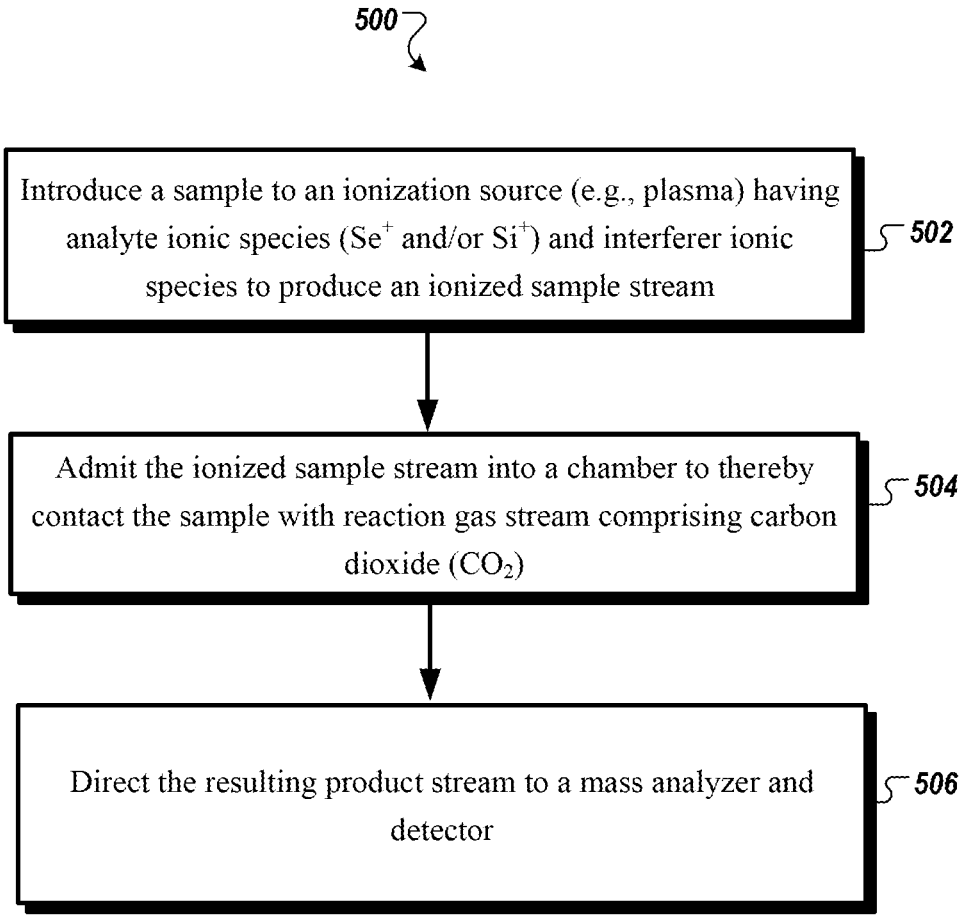
FIG. 5 is a flowchart illustrating an example method for producing a stream of ions for detection and/or quantification of silicon (Si) and/or selenium (Se) in a sample, according to an illustrative embodiment of the invention.

FIG. 5 is a flowchart 500 illustrating an example method for producing a stream of ions for detection and/or quantification of silicon (Si) and/or selenium (Se) in a sample, according to an illustrative embodiment of the invention. Step 502 is introducing the sample to an ionization source such as an ionized carrier gas (e.g., a plasma), thereby producing an ionized sample stream comprising a plurality of ionic species. The plurality of ionic species includes: (i) one or more analyte ionic species, where an analyte ionic species is an ionized form of a species of interest in the sample (the analyte); and (ii) one or more interferer ionic species having nominal m/z substantially equivalent (and hence, creating a detection interference with) that of one or more of the analyte species. In this example, the analyte ionic species includes either or both of $Se^+$ and $Si^+$, and the interferer ionic species can include one or more of the following: $^{78}Ar_2^+$, $^{40}Ar_2^+$, $^{64}Zn^{16}O^+$, $^{14}N_2^+$, and $^{12}C^{16}O^+$.

Step 504 is admitting the ionized sample stream into a chamber (e.g., a reaction cell, such as a dynamic reaction cell, or other suitable enclosure or channel) to thereby contact the ionized sample stream with a reaction gas stream containing carbon dioxide ($CO_2$). In certain embodiments, the chamber is pressurized with the reaction gas prior to and/or during introduction of the ionized sample stream into the cell, and the reaction gas 'stream' includes the volume of reaction gas already in the chamber and/or includes a stream of the reaction gas provided to the chamber, e.g., sufficient to maintain a certain pressure and/or concentration of reaction gas. Contact of the interferer ionic species in the ionized sample stream with the carbon dioxide results in a reaction, producing one or more products that are not interferer ionic species, e.g., ionic species such as $CO_2^+$ and neutral species such as Ar, CO, and $N_2$. The byproduct ions no longer have the same or substantially the same m/z ratio as the analyte ions, and conventional mass filtering can be applied to eliminate the product interferer ions without disruption of the flow of analyte ions. The byproduct neutral species do not interfere with detection of the analyte ions.

Following contact of the ionized sample stream with the reaction gas stream comprising $CO_2$, step 506 is directing the resulting product stream to a mass analyzer and detector for detection and/or quantification of the analyte ion(s) in the sample, e.g., $Se^+$ and/or $Si^+$. For example, the mass analyzer may be a quadrupole mass spectrometer, such that the detector receives mass-filtered ions to produce an electronic signal that corresponds to the number of detected analyte ionic species. The signal may be analyzed to quantify the detected analyte, e.g., to determine a concentration of the analyte in the sample.

Equivalents

While the invention has been particularly shown and described with reference to specific preferred embodiments, it should be understood by those skilled in the art that various changes in form and detail may be made therein without departing from the spirit and scope of the invention as defined by the appended claims.

What is claimed is:

1. A method for producing a stream of ions for detection and/or quantification of silicon (Si) in a petrochemical sample, the method comprising:

introducing a petrochemical sample to an ionization source, thereby producing an ionized sample stream comprising a plurality of ionic species, said plurality of ionic species comprising:

(i) one or more analyte ionic species, said one or more analyte ionic species being an ionized form of one or more species of interest present in the petrochemical sample, said one or more species of interest comprising silicon, and said one or more analyte ionic species comprising $Si^+$; and (ii) one or more interferer ionic species, said one or more interferer ionic species having nominal m/z substantially equivalent to that of $Si^+$;

admitting the ionized sample stream into a chamber to thereby contact the ionized sample stream with a reaction gas stream comprising $CO_2$, thereby reacting the $CO_2$ with at least one of the one or more interferer ionic species and producing one or more products that are not interferer ionic species; and, following contact of the ionized sample stream with the reaction gas stream comprising $CO_2$, directing the resulting product stream to a mass analyzer and detector for detection and/or quantification of silicon in the petrochemical sample.

2. The method of claim 1, wherein the one or more interferer ionic species comprises one or both of $CO^+$ and $N_2^+$.

3. The method of claim 1, wherein the introducing step comprises introducing the sample as a nebulized mist of liquid into the ionization source.

4. The method of claim 1, wherein the sample is a dilution in a solvent.

5. The method of claim 1, wherein the petrochemical sample comprises an organic matrix.

6. The method of claim 1, wherein the contacting step is conducted with a reaction gas stream having a minimum $CO_2$ flow rate of 0.1 mL/min and an ionization source gas flow of no greater than 40 L/min.

7. The method of claim 6, wherein the contacting step is conducted with an ionized sample stream resulting from a liquid sample uptake rate of at least 50 μL/min.

8. The method of claim 6, wherein the liquid sample uptake rate is no greater than 5.0 mL/min.

9. The method of claim 1, wherein the petrochemical sample comprises naphtha.

10. The method of claim 1, wherein the petrochemical sample comprises toluene.

11. The method of claim 1, wherein the petrochemical sample comprises diesel fuel.

12. The method of claim 1, wherein the petrochemical sample comprises gasoline.

* * * * *